United States Patent [19]

Wood

[11] Patent Number: 4,967,901

[45] Date of Patent: Nov. 6, 1990

[54] HEAVY DUTY BOTTLE CARRIER

[75] Inventor: Prentice J. Wood, Hapeville, Ga.

[73] Assignee: The Mead Corporation, Dayton, Ohio

[21] Appl. No.: 452,812

[22] Filed: Dec. 19, 1989

[51] Int. Cl.[5] ..... B65D 5/08

[52] U.S. Cl. ..... 206/139; 229/117.16; 229/117.17

[58] Field of Search ..... 206/139, 427; 289/117.16, 117.17

[56] References Cited

U.S. PATENT DOCUMENTS

| | | | |
|---|---|---|---|
| 2,703,197 | 3/1955 | Brasch | 229/117.17 |
| 3,301,462 | 1/1967 | Starr | 229/136 |
| 3,580,475 | 5/1971 | Mobley | 229/117.17 |
| 4,314,639 | 2/1982 | Gloyer | 206/427 |
| 4,394,905 | 7/1983 | Hackenberg | 206/427 |
| 4,744,507 | 5/1988 | Morsbach | 206/427 |

FOREIGN PATENT DOCUMENTS

| | | | |
|---|---|---|---|
| 644715 | 7/1960 | Canada | 229/117.17 |

*Primary Examiner*—Joseph Man-Fu Moy
*Attorney, Agent, or Firm*—Rodgers & Rodgers

[57] ABSTRACT

Carrier side and end walls foldably joined at their end edges to form a tubular sleeve of generally rectangular cross sectional configuration includes a reinforcing panel foldably joined to the top edge of each of the end walls and secured in flat face contacting relation with the inner surface thereof together with an anchoring panel struck from each of the reinforcing panels and foldably joined to the associated end wall and with top closure panels foldably joined to the top edge of the side walls respectively and secured to the anchoring panels together with a bottom wall structure secured to the lower portions of the sleeve.

14 Claims, 4 Drawing Sheets

HEAVY DUTY BOTTLE CARRIER

TECHNICAL FIELD

This invention pertains to a sleeve type carrier applied to a group of bottles from a position above the bottle group after which bottom and top closure portions are manipulated into closed finished positions.

BACKGROUND ART

U.S. Pat. No. 3,403,839 issued Oct. 1, 1968 concerns a bottle carrier of the general type to which this invention applies but is not especially adapted for use in conjunction with large bottles and is not provided with hand gripping means to render the carrier readily portable.

U.S. Pat. No. 3,627,193 issued Dec. 14, 1971 discloses vertically applied sleeve and is concerned primarily with bottom closure structure for the carrier. This patent is not especially well adapted for use in conjunction with large bottles since it is provided only with a pair of finger receiving apertures in its top structure.

U.S. Pat. No. 3,688,972 issued Sept. 5, 1972 simply discloses an opening feature for cartons such as are disclosed in U.S. Pat. No. 3,627,193.

SUMMARY OF THE INVENTION

According to this invention in one form, a heavy duty bottle carrier having spaced apart side walls and spaced apart end walls which are foldably joined at their end edges to form a generally rectangular sleeve includes a reinforcing panel foldably joined to the top edge of each of the end walls and disposed in flat face contacting relation with the inner surface thereof, a horizontal anchoring panel struck from each of the reinforcing panels and foldably joined to the top edge of the associated end wall, at least one top closure panel foldably joined to the top edge of one of the side walls and secured in flat face contacting relation with the anchoring panels together with bottom wall structure secured to lower portions of the sleeve.

BEST MODE OF CARRYING OUT THE INVENTION

Figure 1:
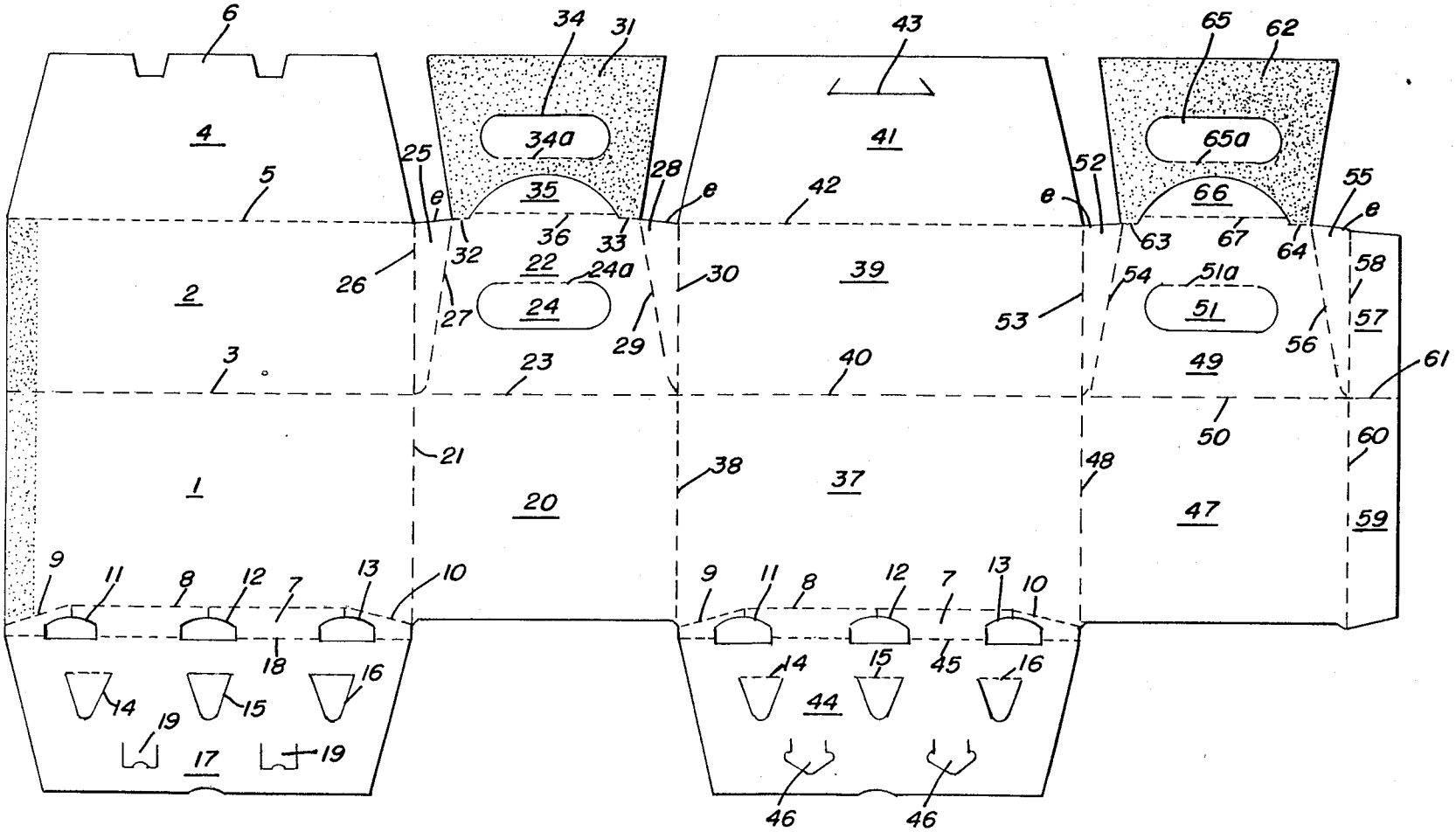
FIG. 1 is a plan view of a blank which embodies this invention as viewed from the inner surface thereof.
Figure 4:
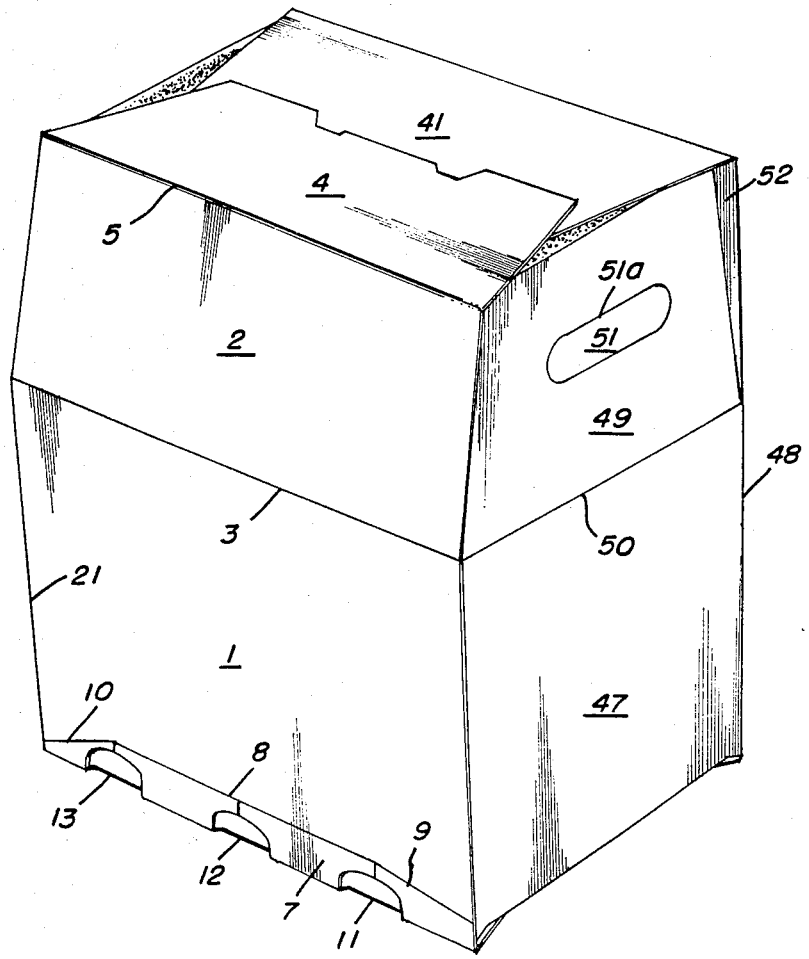
FIG. 4 is a perspective view of a completed set up and loaded carrier formed from the blank of FIG. 1.

With reference to FIGS. 1 and 4, one side wall of the carrier includes a vertical lower portion designated by the numeral 1 and an inwardly inclined upper portion designated by the numeral 2. These wall portions are foldably joined along fold line 3. Top closure panel 4 is foldably joined to wall panel 2 along fold line 5. A locking tab 6 is an integral part of top closure panel 4. A bevelled panel 7 is foldably joined to the bottom edge of the lower side wall portion 1 along a fold line which includes a mid portion 8 and downwardly inclined end portions 9 and 10. Apertures 11, 12 and 13 are formed in bevelled panel 7 for receiving the heels of packaged bottles in a well known manner. Tightening apertures 14, 15 and 16 are formed in bottom wall panel 17 foldably joined to bevelled panel 7 along fold line 18 and function in known manner to receive machine tightening elements used in forming the bottom structure of the carton. Retaining tabs 19 are struck from bottom wall panel 17 and define locking apertures for receiving locking tabs in a manner well known in the art.

An end wall panel includes a vertically disposed lower portion 20 which is foldably joined to vertical portion 1 of the adjacent side wall along fold line 21. An inwardly inclined upper portion 22 of an end wall is foldably joined to vertical portion 20 along fold line 23 and includes a hand gripping cushioning flap 24 struck from panel 22 and foldably joined thereto along fold line 24*a*. A generally triangular shaped web panel 25 is foldably joined to panel 2 along fold line 26 and to panel 22 along fold line 27. Web panel 28 is foldably joined to panel 22 along fold line 29 and an edge thereof is defined by fold line 30.

According to one feature of this invention, a reinforcing panel 31 is foldably joined to the top edge of inwardly sloping end panel 22 along interrupted fold lines 32 and 33. A hand gripping cushioning panel 34 is struck from reinforcing panel 31 and foldably joined thereto along a fold line 34*a*.

Figure 2:
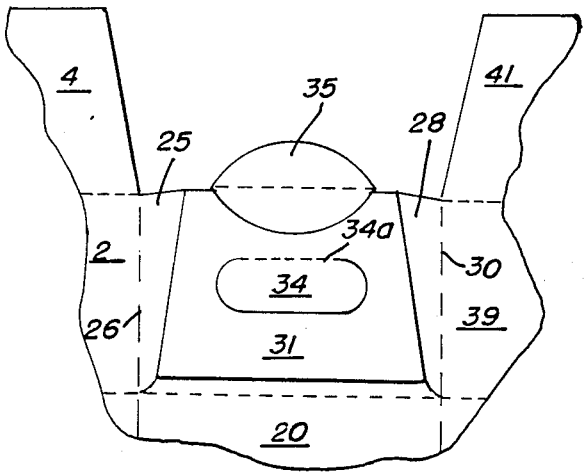
FIG. 2 is a fragmentary view of a portion of FIG. 1 which shows the reinforcing panel folded into face contacting relation with the associated end wall.

Formed according to another feature of this invention is the anchoring panel 35 foldably joined along fold line 36 to the top edge of inwardly sloping end wall panel 22. The interrupted aligned fold lines 32 and 33 are offset somewhat below the fold line 36 as viewed in FIG. 1 so as to prevent folding of anchoring panel 35 simultaneously with the folding of reinforcing panel 31 into flat face contacting relation with inwardly inclined upper portion 22 of the associated end wall as shown in FIG. 2.

The numeral 37 designates the lower vertically disposed portion of a side wall which is foldably joined to end wall vertical portion 20 along fold line 38. Inwardly inclined upper side wall portion 39 is foldably joined to vertical side wall portion 37 along a fold line 40 and to web panel 28 along fold line 30. Top closure panel 41 is foldably joined to upper inclined end wall panel 39 along fold line 42. A locking slot 43 is formed in top closure panel 41.

The bottom structure foldably joined to the bottom portion of vertical side wall panel 37 is identical to the bottom structure foldably joined to the vertical side wall portion 1 except that a pair of locking tabs 46 are struck from this bottom panel 44 and cooperate in known manner with the apertures defined by retaining tabs 19 formed in bottom panel 17. Corresponding parts of the bottom closure structure foldably joined to panel 37 are identified by the same numerals as are used to identify the bottom structure foldably joined to the vertical panel 1.

Vertically disposed end panel 47 is foldably joined to vertical portion 37 of the adjacent side wall along fold line 48 and inwardly inclined upper panel 49 is foldably joined to lower vertical end panel 47 along fold line 50 and a hand gripping cushioning flap 51 is struck from panel 49 and foldably joined thereto along fold line 51*a*.

A generally triangular web panel 52 is foldably joined to inwardly inclined side panel 39 along a fold line 53 and to panel 49 along a fold line 54. A generally triangular shaped web panel 55 is foldably joined to panel 49 along a fold line 56 and to the upper portion 57 of a conventional glue flap along a fold line 58. Vertical portion 59 of the glue flap is foldably joined to panel 47 along fold line 60. A fold line 61 defines the junction between panels 57 and 59.

A reinforcing panel 62 is foldably joined to panel 49 along interrupted fold lines 63 and 64. A hand cushioning flap 65 is struck from reinforcing panel 62 and is foldably joined thereto along fold line 65*a*.

Anchoring panel 66 is foldably joined to panel 49 along fold line 67. The interrupted fold lines 63 and 64 are offset slightly below fold line 67 as viewed in FIG. 1 in order to prevent folding of anchoring panel 66 simultaneously with the folding of reinforcing panel 62 into flat face contacting relation with panel 49.

In order to form the carrier from the blank of FIG. 1, an application of glue is made to the inner surfaces of reinforcing panels 31 and 62 as indicated by stippling in FIG. 1. These panels are then folded forwardly and downwardly into flat face contacting relation with the panels 22 and 49 respectively. FIG. 2 simply shows one of these panels namely panel 31 after this folding operation is completed.

Figure 3:
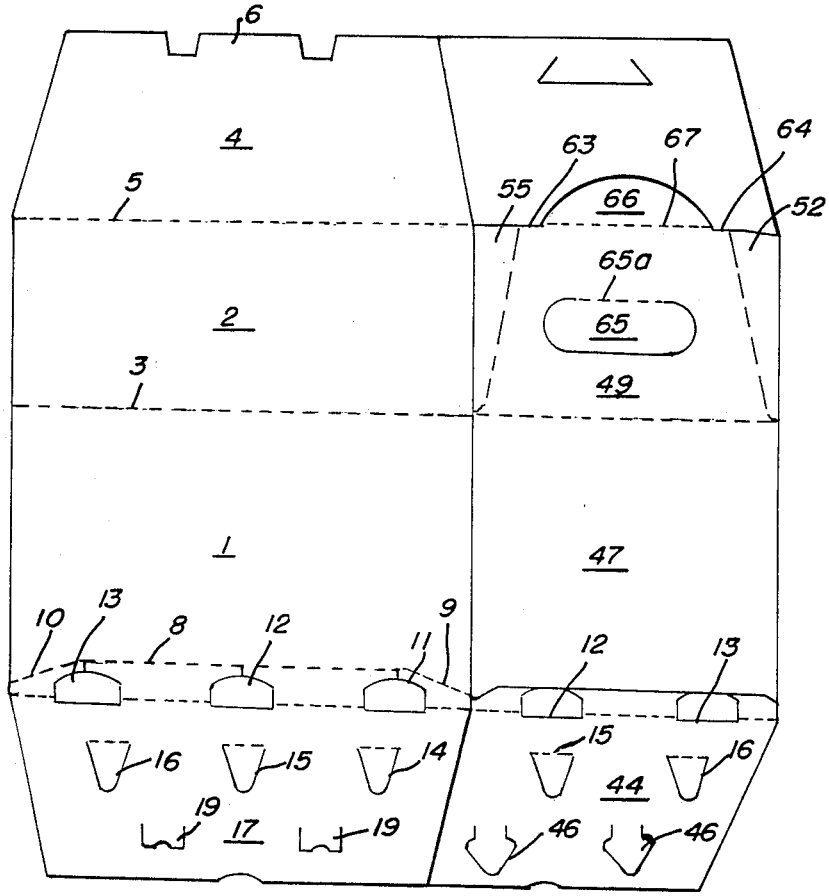
FIG. 3 is a view of the blank following manipulation thereof by the carrier manufacturer into collapsed condition.

In order to manipulate the blank of FIGS. 1 and 2 into the condition represented in FIG. 3, an application of glue is made to the left hand edges of panels 1 and 2 as indicated by stippling in FIG. 1. Thereafter end wall panels 47 and 49 together with glue lap panels 57 and 59 and the reinforcing panel 62 and anchoring panel 66 along with triangular panels 52 and 55 are elevated and folded toward the left along fold lines 48 and 53 to occupy positions of flat face contacting relation with panels 37, 39 and 41. Thereafter panels 1, 2, 4 and 17 are elevated and folded to the right along fold lines 21 and 26 to occupy the positions indicated in FIG. 3. Of course this operation causes the glue on panels 1 and 2 to adhere to the lap panels 57 and 59 so as to secure the components to the positions shown in FIG. 3. The structure as shown in FIG. 3 is finished as far as manufacturing is concerned and is shipped in this collapsed form to the user who applies it to a group of bottles.

In order to apply the carrier to a group of bottles it is manipulated into sleeve form with the side walls in parallel relation to each other and with the end walls similarly arranged to form a generally rectangular structure which is lowered from above about the bottle group and closed top and bottom to occupy the position shown in FIG. 4.

Figure 5:
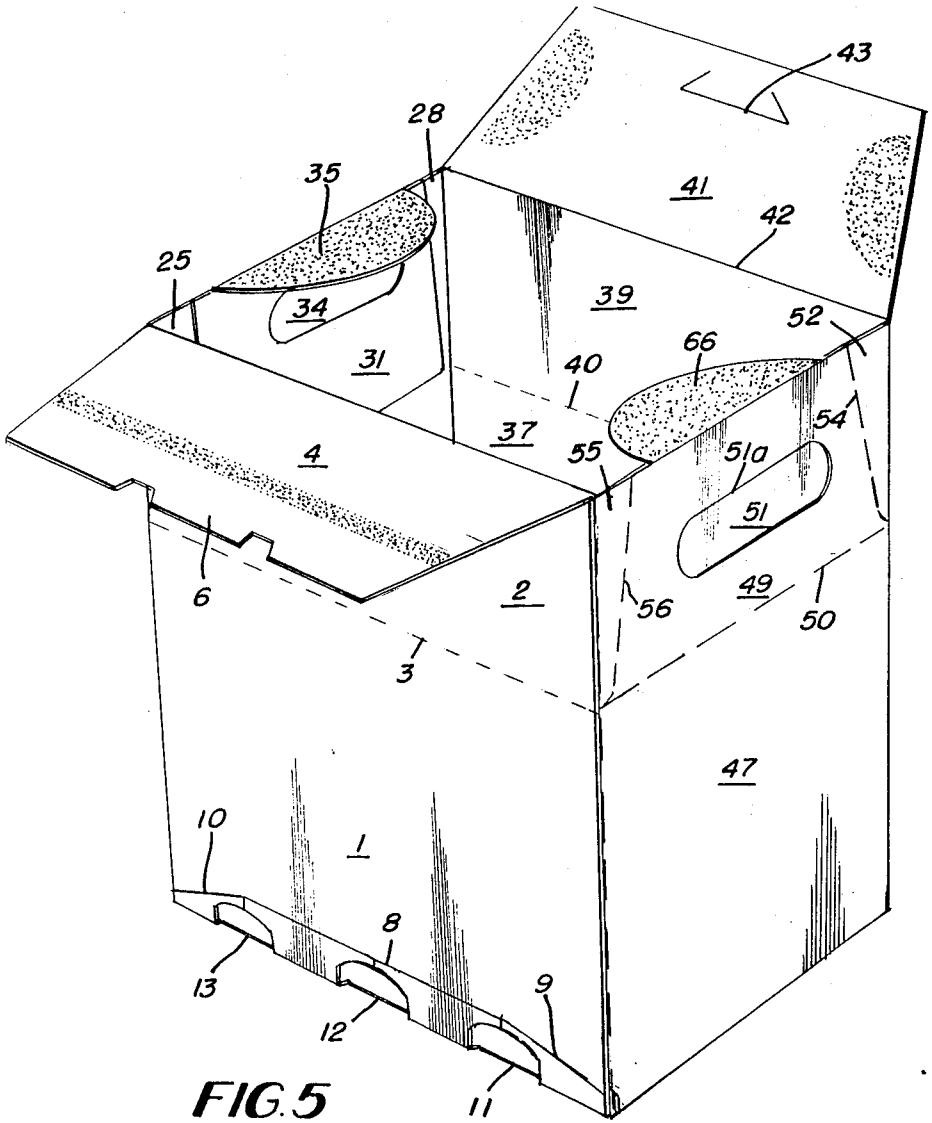
FIG. 5 is a perspective view of a carrier formed from the blank of FIG. 1 and shown with the carrier top components in opened unloaded condition.

In order to close the top portion of the carrier, the panels 2, 22, 39, 49 and 57 are inclined inwardly and the webs 25, 28, 52 and 55 are swung into flat face contacting relation with the inwardly inclined side wall panels 2 and 39 and the anchoring panels 35 and 66 are folded into substantially horizontal positions as shown in FIG. 5 after glue is applied thereto and the top closure panels 4 and 41 are swung inwardly into engagement with the anchoring panels 35 and 66 to cause the anchoring panels to adhere to the top closure panels. Also the top closure panels are secured to each other by an appropriate application of glue to panel 4 as indicated by stippling in FIG. 5 or to the overlapping parts of both closure panels as is obvious.

The bottom structure of the carrier is closed in known manner by simply folding the bottom lap panel 17 inwardly followed by inward folding of bottom lap panel 44 so that the locking tabs 46 overly the apertures defined by retaining tabs 19. The carrier is tightened by machine elements which enter the tightening apertures 14–16 in each lap panel and draw these panels inwardly. Thereafter machine elements drive the locking tabs 46 into the apertures defined by retaining tabs 29.

The carrier as shown and described is arranged to package two rows of bottles. The sum of two bottle diameters should be somewhat greater than the width of the end walls to minimize bowing of the end walls in accordance with one facet of this invention.

Also the fold lines between the lower parts of the side walls and the bevelled panels 7 are inclined downwardly as indicated at 9 and 10 to aid in limiting bowing of the end walls and to allow the fold lines 21, 38, 48 and 60 between the side and end walls to extend to points close to the bottom wall.

The length of the third edge designated e of webs 25, 28, 52 and 55 is such as to cause the associated reinforcing panel 31 or 62 to rest against the bottles in the carrier.

Figure 6:
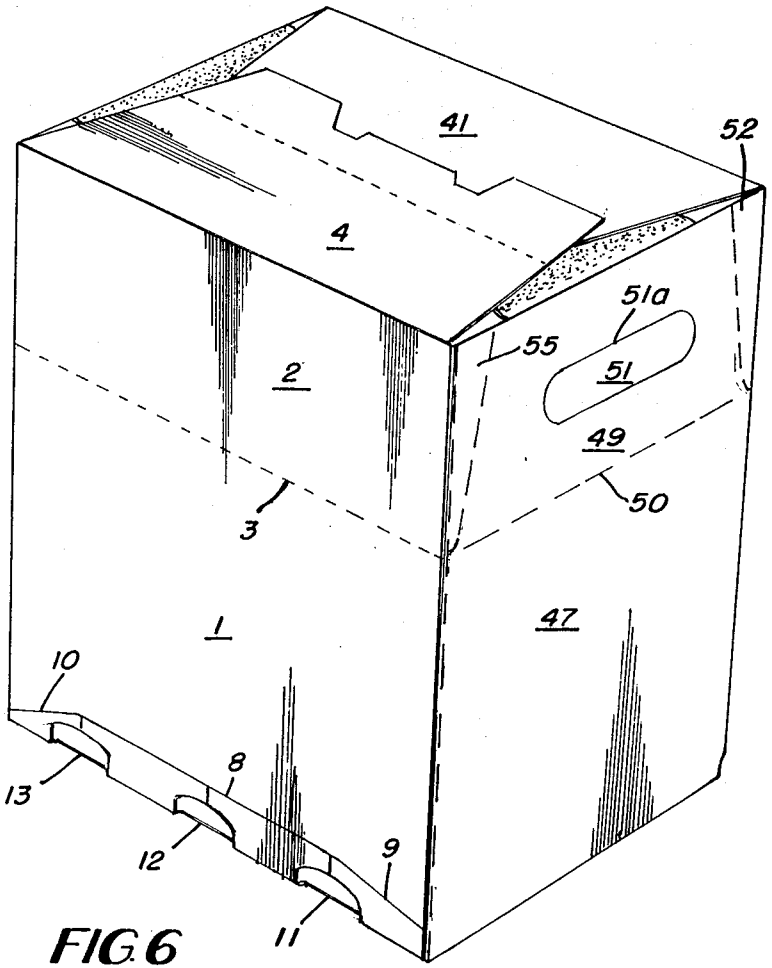
FIG. 6 is a view similar to FIG. 5 but which shows the carrier closed and in condition for the return of empty bottles to their retail source.

Once the loaded carrier is purchased by the ultimate consumer and the contents of the bottles are ready for use, the carrier panels are manipulated into the condition represented in FIG. 5. More specifically, top closure panels 4 and 41 are folded outwardly into the positions shown in FIG. 5. This operation of course breaks the glue seal between anchoring panels 35 and 66 and the top closure panels and any glue bond that may have been used to secure top closure panels 4 and 41 to each other. This operation is also accompanied by outward folding of triangular panels 25, 28, 52 and 55 together with outward folding of the inwardly inclined upper side wall panels 2 and 39 and of the inwardly inclined end wall panels 22 and 49. When so manipulated, the carrier as shown in FIG. 5 is ready for convenient unloading and after the contents of the bottles are used the carrier is ready for easy reloading. Thereafter, the top closure panels 4 and 41 are manipulated into closed positions as shown in FIG. 6 and the locking tab 6 is inserted into locking slot 43 and the carrier then appears as shown in FIG. 6. The empty bottles may then be returned in the carrier to the retail source from whence they came.

From the above description, it is apparent that the carrier is unusually strong due in part to the reinforcing panels 31 and 62. Also a substantial measure of mechanical strength is imparted by the anchoring panels 35 and 66 to which the top closure panels 4 and 41 are secured. Also large bottles can conveniently be handled by use of the hand hold apertures defined by the cushioning tabs 24 and 34 and 51 and 65 after the cushioning panels are manipulated inwardly along their fold lines 24*a* and 34*a* and 51*a* and 65*a* respectively.

I claim:

1. A bottle carrier comprising spaced apart side walls and spaced apart end walls foldably joined at their ends with corresponding ends of said side walls to form a sleeve of generally rectangular cross sectional configuration, a reinforcing panel foldably joined to the top edge of each of said end walls along a pair of interrupted aligned fold lines and disposed in flat face contacting relation therewith, an anchoring panel struck from each of said reinforcing panels and foldably joined to the associated end wall, at least one top closure panel foldably joined to the top edge of one of said side walls and secured to said anchoring panels in flat face contacting relation therewith, and a bottom wall secured to lower portions of said sleeve.

2. A bottle carrier according to claim 1 wherein each of said reinforcing panels is disposed in flat face contacting relation with the inner surface of the associated end wall.

3. A bottle carrier according to claims 2 wherein each of said reinforcing panels is secured to the associated end wall by adhesive.

4. A bottle carrier according to claim 1 wherein each of said anchoring panels is foldably joined to the top edge of the associated end wall.

5. A bottle carrier according to claim 1 wherein a top closure panel is foldably joined to the top edge of each of said side walls and secured to each of said anchoring panels and to each other.

6. A bottle carrier according to claim 1 wherein a hand gripping aperture is formed in each of said end walls and wherein a coincidental hand gripping aperture is formed in the associated one of each of said reinforcing panels.

7. A bottle carrier according to claim 1 wherein the fold lines adjoining said reinforcing panels and said anchoring panels to the associated end wall are offset somewhat from each other.

8. A bottle carrier according to claim 1 wherein the carrier is arranged to package two rows of bottles and wherein the sum of the diameters of two bottles is somewhat greater than the width of the end walls to minimize bowing of these walls.

9. A bottle carrier according to claim 1 wherein a bevelled panel is foldably joined to the bottom edge of each side wall and to each side edge of said bottom wall and wherein the ends of the fold line between each of said bevelled panels and the associated side wall extend toward the bottom wall at an angle of departure from the mid portion of the associated said fold line to aid in minimizing bowing of the end walls and to allow the fold lines between the side and end walls to extend to points close to the bottom wall of the carrier.

10. A bottle carrier comprising a bottom wall having oppositely disposed side edges, a pair of side walls foldably joined respectively to said side edges of said bottom wall, a pair of end walls having oppositely disposed end edges foldably joined respectively to corresponding end edges of said side walls to form a generally rectangular structure, a reinforcing panel foldably joined to the top edge of each of said end walls along a pair of interrupted fold lines and disposed in flat face contacting relation with the inner surface of the associated end wall, a horizontally disposed anchoring panel struck from each of said reinforcing panels and foldably joined to each of said end walls, a pair of top closure panels foldably joined to the top edges of said side walls respectively and releasably secured to the upper surfaces of said anchoring panels and to each other and locking means including a locking tab and a cooperating locking slot formed respectively in said top closure panels for disjointably securing such panels together.

11. A bottle carrier comprising a bottom wall having oppositely disposed side edges, a pair of side walls foldably joined respectively to said oppositely disposed side edges and having inwardly inclined upper portions and substantially vertical lower portions, a pair of end walls having substantially vertical lower portions whose end edges are foldably joined to the end edges of said lower portions of said side walls and having inwardly inclined upper portions, a pair of upwardly convergent fold lines formed in each of said inwardly inclined upper portions of said end walls and having their lower ends adjacent the lower corner of the associated inwardly inclined upper portion of the associated end wall, a generally triangular web panel at each corner of the carrier and foldably joined along one edge to the adjacent end edge of the adjacent inwardly inclined upper portion of the associated side wall and foldably joined to the associated end wall along a second edge thereof coinciding with the adjacent upwardly convergent fold line, a reinforcing panel foldably joined to the upper edge of each of said inwardly inclined upper portions of each end wall and disposed in flat face contacting relation therewith, a horizontally disposed anchoring panel struck from each of said reinforcing panels and foldably joined to the upper edge of the associated inwardly inclined upper portion of each end wall, a pair of top closure panels foldably joined respectively to the top edges of said inwardly inclined upper portions of each side wall and secured to the upper surfaces of said anchoring panels and to each other.

12. A bottle carrier according to claim 11 wherein a third upper edge of each said web panels is dimensioned so as to cause said reinforcing panel to rest against the bottles loaded in the carrier.

13. A bottle carrier according to claim 11 wherein said top closure panels are detachable from said anchoring panels and from each other and wherein said triangular web panels are foldable into the planes of their associated end panels to condition the carrier for easy unloading for consumer use of the bottle contents.

14. A bottle carrier according to claim 11 wherein a locking tab is formed in one of said top closure panels and a cooperating locking slot is formed in the other of said closure panels for receiving said locking tab thereby to close the carrier following loading of empty bottles therein.

* * * * *